US007744518B2

(12) United States Patent
Belleculee et al.

(10) Patent No.: US 7,744,518 B2
(45) Date of Patent: Jun. 29, 2010

(54) FOLDER HAVING A RETRACTABLE COVERING CAM FOR CHANGING OPERATING MODE

(75) Inventors: Cyrille Belleculee, Les Sorinieres (FR); Michel Griffon, Gorges (FR)

(73) Assignee: Goss Systemes Graphiques Nantes, Nantes (FR)

( * ) Notice: Subject to any disclaimer, the term of this patent is extended or adjusted under 35 U.S.C. 154(b) by 0 days.

(21) Appl. No.: 11/895,957

(22) Filed: Aug. 28, 2007

(65) Prior Publication Data

US 2008/0064583 A1 Mar. 13, 2008

(30) Foreign Application Priority Data

Aug. 28, 2006 (FR) ..... 06 07564

(51) Int. Cl.
*B31B 1/56* (2006.01)

(52) U.S. Cl. ..... 493/359; 493/357; 493/416; 493/424; 493/426; 493/428; 493/429

(58) Field of Classification Search ..... 493/352–353, 493/356–357, 359–360, 405, 416, 422, 424–429, 493/454

See application file for complete search history.

(56) References Cited

U.S. PATENT DOCUMENTS 2,016,486 A 10/1935 Crafts
5,797,319 A * 8/1998 Tomczak ..... 101/216
6,093,139 A * 7/2000 Belanger ..... 493/353
6,547,232 B2 * 4/2003 Herda et al. ..... 101/232
6,932,755 B2 * 8/2005 Teshima et al. ..... 493/434
2007/0167306 A1 7/2007 Prum

FOREIGN PATENT DOCUMENTS

WO WO 2005/102889 11/2005

* cited by examiner

*Primary Examiner*—Christopher Harmon
(74) *Attorney, Agent, or Firm*—Davidson, Davidson & Kappel, LLC

(57) ABSTRACT

This folder includes a device for cutting sheets from a web of paper, a folding cylinder which is provided with movable retention devices and movable blades for folding the sheets cut from the web, a cam for controlling the movement of the movable retention devices by contact with cam followers, a cam for controlling the movement of the tucking blades by contact with cam followers, and at least one covering cam.

The covering cam includes two semi-cams which can each be moved radially between a retracted position and an extracted position, the covering cam being in a configuration for straight operation when the semi-cams are in a retracted position and in a configuration for collect operation when the semi-cams are in an extracted position.

9 Claims, 6 Drawing Sheets

FOLDER HAVING A RETRACTABLE COVERING CAM FOR CHANGING OPERATING MODE

This claims the benefit of French Patent Application No. 06 07564, filed on Aug. 28, 2006 and hereby incorporated by reference herein.

The invention is used in particular for folding webs of paper printed by offset presses.

BACKGROUND TO THE INVENTION

Two main categories of folder of the above-mentioned type are known, that is to say, "jaw folders" and "rotary folders". In these two categories of folder, the retention devices are constituted by pins which engage in the edges of the cut sheets.

In jaw folders, the folding cylinder co-operates with a jaw cylinder in order to fold the sheets. More precisely, the sheets are pushed by the "tucking blades" between the jaws of the jaw cylinder in order to fold the sheets. In rotary folders, the jaw cylinder is replaced by two grooved rollers.

These folders may operate in "straight" mode and in "collect" mode. In straight mode, each sheet is cut, retained on the folding cylinder, then individually folded by means of co-operation of a tucking blade either with the jaw cylinder or with the grooved wheels, depending on the category of the folder. The pins which retain the sheet are simultaneously disengaged from the sheet in order to allow the folded sheet to be discharged in the form of a book. The movement of the pins and the tucking blades is carried out by means of the control cams on which cam followers in the form of rollers which are connected to the tucking blades and to pins travel.

These control cams have, for example, hollow portions in which each roller can be introduced in order to bring about the retraction of the corresponding pins and thus release the sheet, or in order to bring about the projection of the corresponding tucking blade in order to produce a fold in the sheet.

In collect mode, a first cut sheet is retained on the folding cylinder in order to be covered with a second cut sheet. The collect mode therefore allows books to be produced which include a greater number of pages.

In order to prevent the retraction of the pins retaining the first sheet and the projection of the corresponding tucking blade, two covering cams are arranged laterally at the side of the cams for controlling the pins and the tucking blades. These covering cams have projections in the region of the hollow portions of the control cams. The shafts which carry the rollers which are intended to travel on the control cams also carry other rollers which are intended to travel on the covering cams.

In this manner, these other rollers travel on the projections of the covering cams and prevent the rollers associated with the control cams from being introduced in the corresponding hollow portions.

The covering cams therefore neutralise zones of the control cams and prevent, in a controlled manner, the movement of the pins and the tucking blades.

In collect mode, the covering cams rotate about the axis of the folding cylinder at a speed which is generally equal to 2.5 times that of the folding cylinder, when the folding cylinder is provided with five retention devices and five tucking blades. When the folding cylinder includes three retention devices and three tucking blades, the speed of the covering cam is equal to 1.5 times that of the folding cylinder.

In order to move from collect mode to straight mode, the covering cams must be disengaged and immobilised in an angular position in which they do not interfere with the control cams. The operations must be carried out in reverse order to return to collect mode.

This changing of mode therefore requires precise angular positioning, in particular in order to immobilise the covering cam(s) and to ensure that they are reengaged. This is restrictive and further significantly limits the possibilities for automating the changing of the folding mode.

SUMMARY OF THE INVENTION

An object of the invention provides a folder which allows more simple movement from collect mode to straight mode.

An embodiment of the present invention provides a folder for cutting and folding a web of paper, the folder being of the type comprising:

a device for cutting sheets from the web, a folding cylinder which is provided with movable retention devices and movable blades for folding the sheets cut from the web, the cylinder being able to be rotatably moved about the axis thereof, a cam for controlling the movement of the movable retention devices through contact with cam followers, a cam for controlling the movement of the tucking blades through contact with cam followers, and at least one covering cam which has a configuration for collect operation, in which the covering cam neutralises zones of at least one of the control cams, and a configuration for straight operation in which the covering cam does not interfere with the zones.

The present invention provides a folder wherein the covering cam includes two semi-cams which are substantially mutually symmetrical relative to the axis of the cylinder and which can each be radially moved between a retracted position and an extracted position, the covering cam being in a configuration for straight operation when the semi-cams are in a retracted position and in a configuration for collect operation when the semi-cams are in an extracted position.

According to specific embodiments, the folder may include one or more of the following features, taken in isolation or according to any technically possible combination:

the covering cam is intended to neutralise zones of the cam for controlling the movement of the retention devices and zones of the cam for controlling the movement of the tucking blades;

the configurations for collect operation and straight operation are stable;

the cam includes at least one toggle joint mechanism which moves via an aligned position when moving from the configuration for collect operation to the configuration for straight operation;

the covering cam includes a hub on which the two semi-cams are articulated, each semi-cam being further connected to the hub by means of a toggle joint mechanism which moves via an aligned position when moving from the configuration for collect operation to the configuration for straight operation;

the covering cam includes at least one device for returning each semi-cam to the extracted position thereof;

the return device is a gas spring;

the folder includes a switching member for controlling the covering cam and a device for moving the switching member between a radially remote position in which the switching member is intended to guide an element which is carried by the covering cam radially outwards so that the covering cam moves into a configuration for collect operation, and a close position in which the switching member is intended to guide the element radially inwards in order to move the covering cam into a configuration for straight operation;

the folder includes a rotary folder including two rollers which co-operate with the tucking blades of the folding cylinder; and the folder includes a jaw folder which includes a jaw cylinder which co-operates with the tucking blades of the folding cylinder.

BRIEF DESCRIPTION OF THE DRAWINGS

The invention will be better understood from a reading of the following description, given purely by way of example and with reference to the appended drawings, in which.

DESCRIPTION OF PREFERRED EMBODIMENTS

Figure 1:
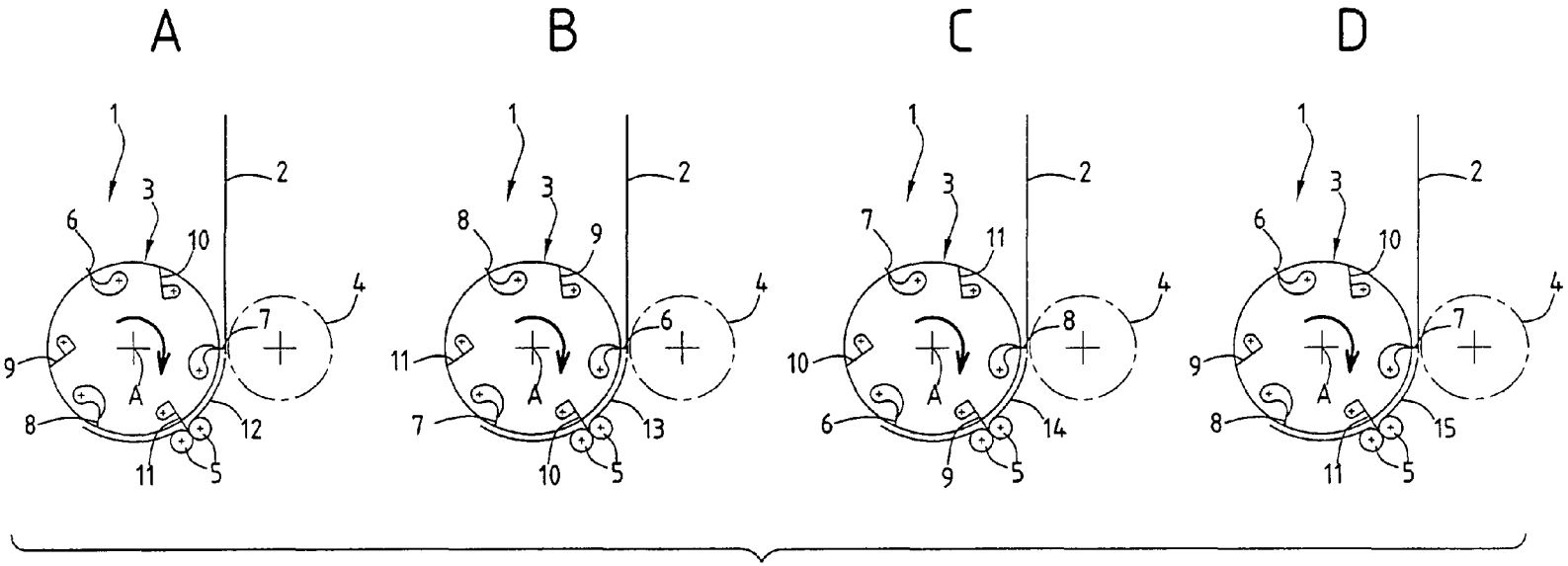
FIGS. 1 and 2 are schematic views illustrating the principles of the collect and straight folding modes.

FIG. 1 schematically illustrates a rotary folder 1, it being understood that the invention which will be described below with reference to FIGS. 3 to 7 may apply equally to rotary folders or to jaw folders or to any other type of folder.

The folder 1 allows a web 2 to be cut and folded which has been printed, for example, by an offset printing press, in order to create books.

Conventionally, the folder 1 includes a folding cylinder 3, a cutting cylinder 4 which is illustrated with dashed lines and two grooved rollers 5.

In the example described, the folder is a 3/2 folder and therefore includes three series of pins 6, 7 and 8 and three tucking blades 9, 10 and 11.

The series 6, 7 and 8 of pins and the tucking blades 9, 10 and 11 are mounted so as to be able to move on the folding cylinder 3 under the action of rollers which travel on control cams which are not illustrated. More generally, these rollers may be referred to as cam followers. These rollers are carried by the folding cylinder 3 and rotatably driven thereby.

In the straight operating mode, illustrated in FIG. 1, a sheet 12 has been cut from the web 2 by the cylinder 4 and has been retained at that location by the series of pins 8.

As illustrated in part A of FIG. 1, when the tucking blade 11 is located opposite the rollers 5, the corresponding roller is introduced into a hollow portion of the corresponding control cam, which brings about the projection of the blade 11 which engages between the rollers 5, pushing the sheet 12 at that location. The blade 11 forms a fold in the sheet 12.

At the same time, the roller associated with the series of pins 8 has been introduced into a hollow portion of the corresponding control cam which brings about the retraction of the series of pins 8 which allows the rollers 5 to discharge the sheet 12. The sheet 12 is then provided with a fold which is transverse relative to the movement direction and forms a book including a single sheet.

Parts B to D in FIG. 1 illustrate how the folder 1 continues to cut and subsequently fold sheets 13, 14 and 15 from the web 2, the folding cylinder 3 continuing to rotate in a clockwise direction in FIG. 1.

Figure 2:
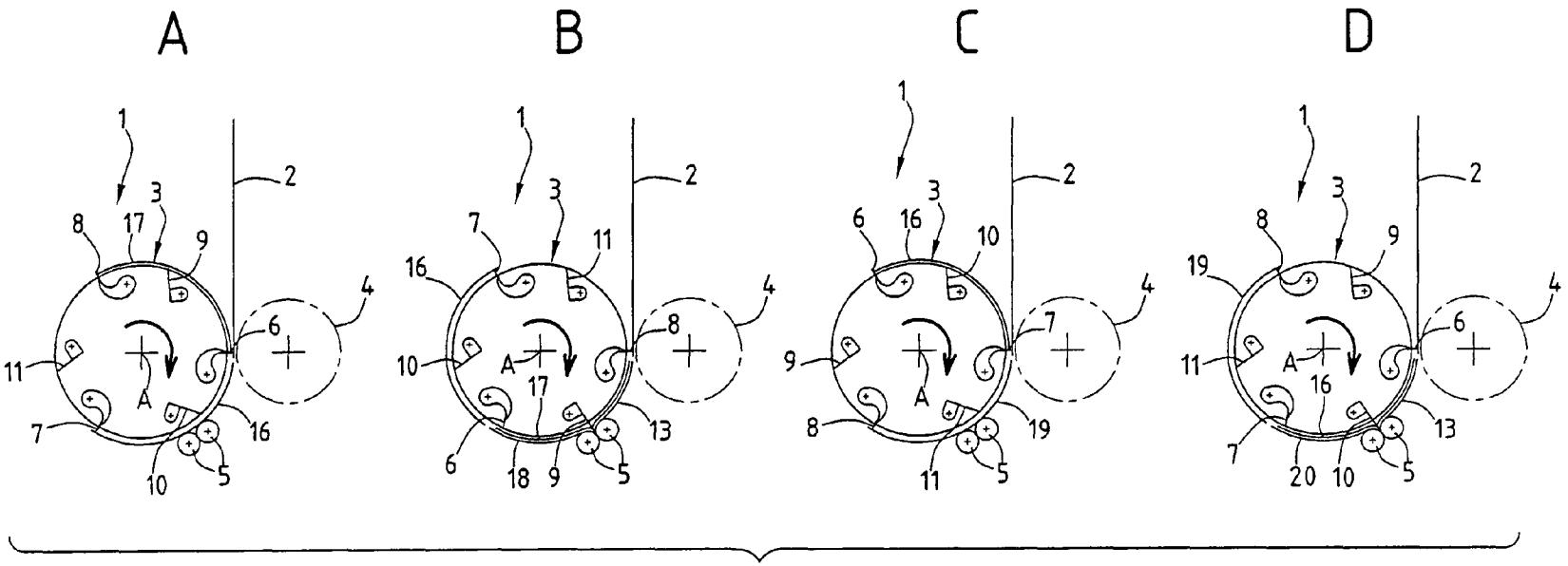

FIG. 2 illustrates the collect folding mode, with parts A to D again illustrating successive steps.

In contrast to what happens in straight folding mode, and as illustrated in part A, a sheet 16 cut from the web 2 is retained on the folding cylinder 3 and is not folded when it passes opposite the rollers 5. This may be achieved by temporarily neutralising the corresponding reliefs of the cams for controlling the series of pins and tucking blades, using one or more covering cams.

It should be noted that the folding cylinder 3 further carries another sheet 17 which has been cut beforehand from the web 2 and which is retained on the cylinder 3 by the series of pins 6.

In part B of FIG. 2, a sheet 18 is cut and rolled on the sheet 17 then, when the tucking blade 9 is located facing the rollers 5, the blade and the series of pins 6 are activated in order to release the sheets 17 and 18 and push them between the rollers 5 in order to form at that location a book of two sheets provided with a transverse fold.

To this end, the corresponding reliefs of the control cams have not been neutralised by the covering cam(s).

Parts C and D of FIG. 2 illustrate the subsequent cutting of two other sheets 19 and 20. The collect folding mode therefore allows books to be produced with a greater number of pages.

FIGS. 3 to 7 illustrate a folder according to the invention.

Figure 3:
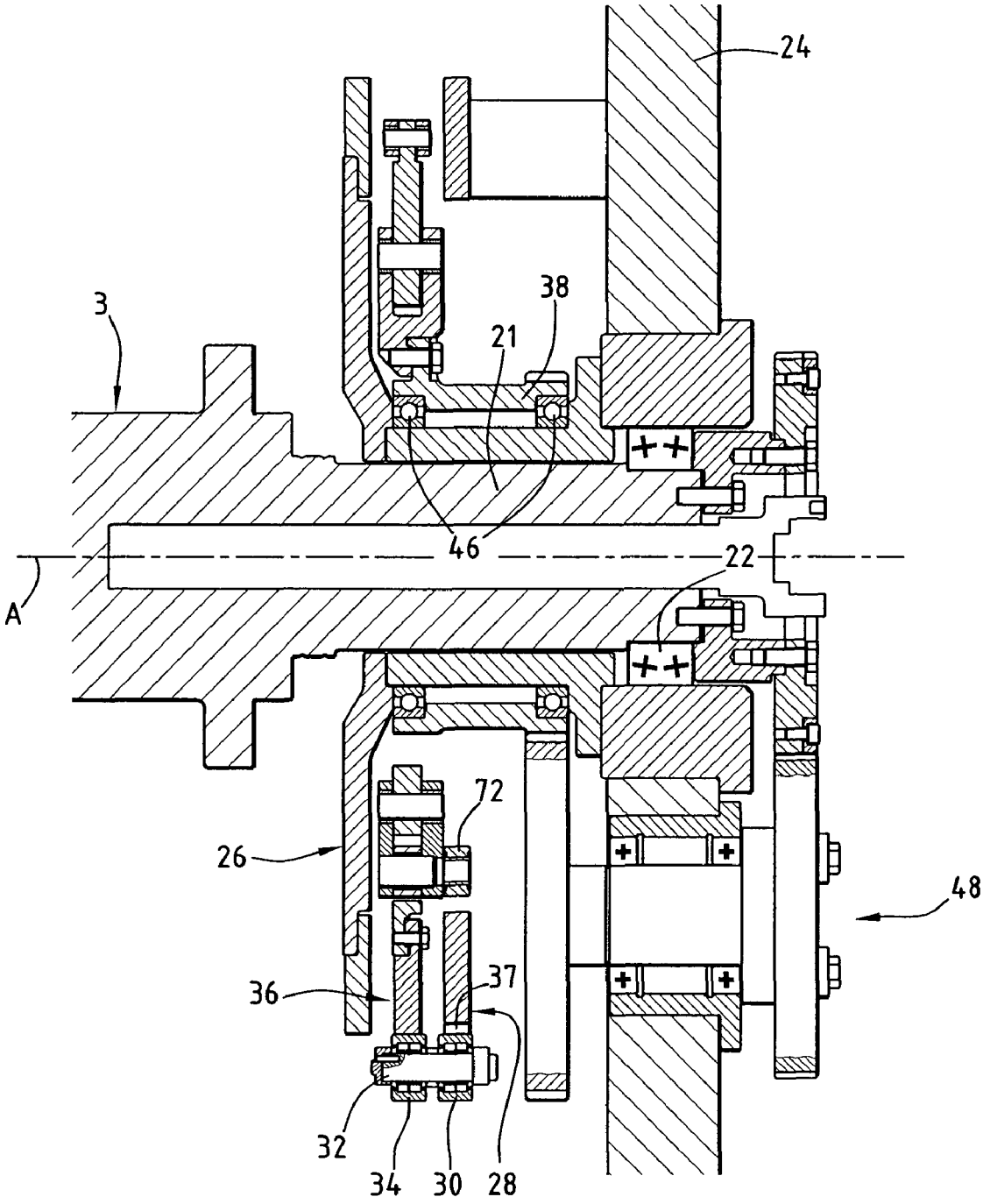
FIG. 3 is a partial schematic section illustrating the various cams of a folder according to the invention.

FIG. 3 schematically illustrates an end 21 of the folding cylinder 3 which is received via a bearing 22 in one of the lateral walls 24 of the frame of the folder 3. The wall 24 illustrated is, for example, the one located at the service side.

The other lateral wall of the frame, located at the transmission side, is provided with means which allow the cylinders and rollers of the folder and in particular the folding cylinder 3 to be rotatably driven about the axis A thereof.

The cam 26 for controlling the series of pins 6 to 8 can be seen in FIG. 3; this cam 26 is arranged around the end 21 of the cylinder 3 and is fixed to the wall 24.

Laterally closer to the wall 24, it is also possible to see the cam 28 for controlling the tucking blades 9 to 11, this cam 28 is also fixed on the lateral wall 24. It is also possible to see one of the cam followers 30 or rollers which are intended to co-operate with the cam 28 and activate the tucking blades 9 to 11. On the shaft 32, which carries the cam follower 30, there is also mounted another cam follower 34 which is intended to co-operate with the covering cam 36. This covering cam 36 is laterally interposed between the two control cams 26 and 28.

It should be noted that the symmetrical cam followers 30 and 34 of those illustrated have not been illustrated in the upper portion of FIG. 3.

In FIG. 3, a hollow portion 37 of the control cam 28 can be seen in which the cam follower 30 cannot be introduced owing to the fact that the cam follower 34 is resting on the covering cam 36. This is typically the phenomenon which is observed during collect operation as described below.

In the same manner, each alternate cam follower of the control cam 26 and each cam follower of the control cam 28 are associated with another cam follower which is intended to co-operate with the covering cam 36. However, these latter cam followers are located in different planes of FIG. 3 and therefore cannot be seen in this Figure.

All the cam followers are carried by the folding cylinder 3 and therefore rotate therewith about the axis A thereof.

Figure 4:
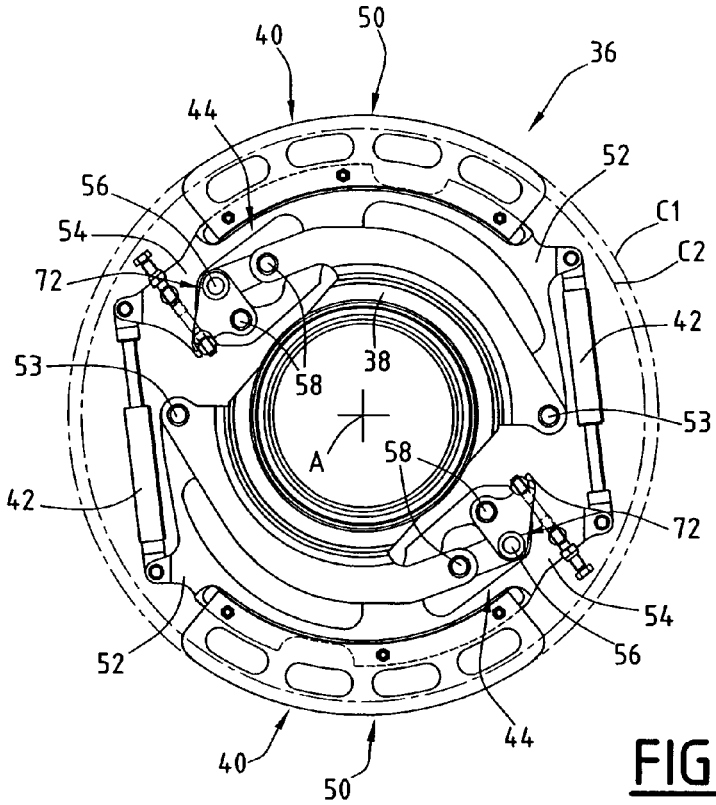
FIGS. 4 and 5 are schematic lateral views illustrating the covering cam of FIG. 3, in the configuration for collect operation and in the configuration for straight operation, respectively.
Figure 5:
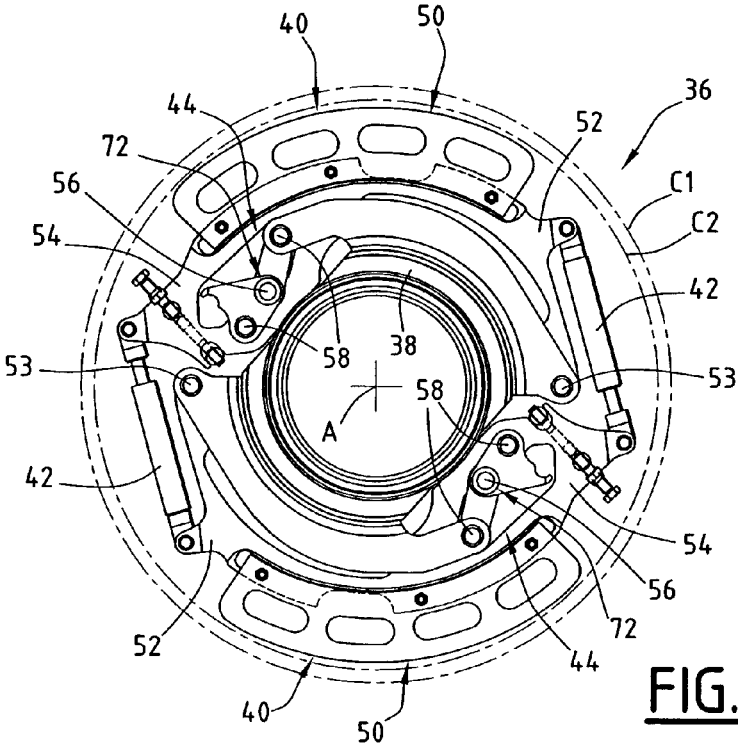

As illustrated in FIGS. 3 to 5, the covering cam 36 principally includes:

a central hub 38, two semi-cams 40, two gas springs 42 for returning the semi-cams 40 radially outwards, and two toggle joint mechanisms 44.

The covering cam 36 has a shape and an arrangement of the elements thereof which are substantially symmetrical relative to the axis A.

The hub 38 thereof is arranged around the end 21 of the cylinder 3 and, owing to the roller bearings 46 thereof, may pivot freely relative thereto.

A gear train 48 is carried by the wall 24 in order to rotatably drive the covering cam 36 about the axis A, from the end 21 of the cylinder 3, at a rotation speed which is, for example, 1.25 times that of the cylinder 3, if the cylinder 3 is provided with five tucking blades and five retention devices. If the folding cylinder 3 is provided with three tucking blades and three retention devices, the speed of the covering cam 36 is 0.75 times that of the folding cylinder 3.

Owing to the symmetry of the covering cam 36, only a semi-cam 40 will be described below.

The semi-cam 40 is generally in the form of a circular arc and has a radially outer surface 50 which is intended to come into contact with the cam followers 34.

A first end 52 of the semi-cam 40 is articulated to the hub 38 at a point 53. The other end 54 of the semi-cam 40 is connected to the end 52 of the other semi-cam 40 by a spring 42 and to the hub 48 by means of a toggle joint mechanism 44.

The semi-cam 40 can be moved radially between two positions by means of pivoting relative to the hub 38.

A first position is illustrated in FIG. 4. This is an extracted position. In this position, the surface 50 is located radially at the outer side as illustrated by the outer circle C2 in dot-dash lines.

When the two semi-cams are in this position, the two springs 42 are in relaxed positions and the toggle joint mechanisms 44 are in non-aligned positions and the ends 54 of the semi-cams are more remote from the axis A. The folder 1 can then operate in collect mode as will be described below.

FIG. 5 illustrates the second position, that is to say, the retracted position. In this position, the surface 50 is located further radially inwards as illustrated by the inner circle C2. The springs 42 are in compressed positions and the corresponding ends 54 of the semi-cams 40 are therefore closer to the axis A. The toggle joint mechanisms 44 are still in non-aligned positions but in positions which are different from those which they occupy in FIG. 4. The toggle joint mechanisms 44 are at travel end positions.

FIG. 5 corresponds to a straight operating mode of the folder 1.

When moving from the configuration of FIG. 4 to the configuration of FIG. 5, the toggle joint mechanisms 44 move via aligned positions in which their intermediate articulations 56 and their articulations 58 for connection to the semi-cams 40 and to the hub 38 are aligned.

In this manner, the configurations illustrated in FIGS. 4 and 5 are stable configurations.

Figure 6:
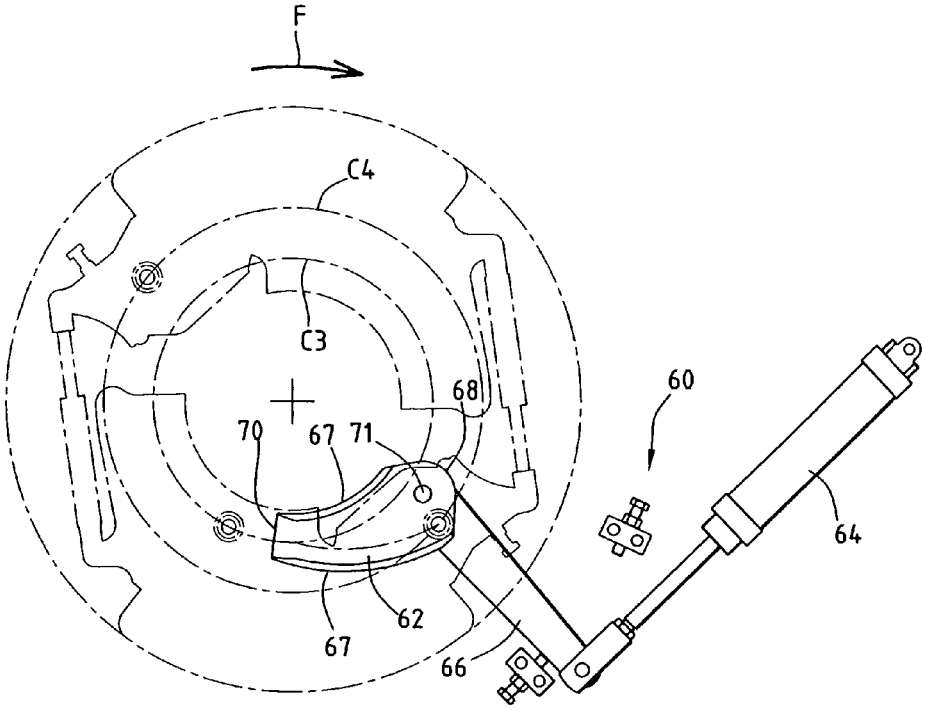
FIGS. 6 and 7 are lateral schematic views illustrating the control switching member of the covering cam in the straight operating position and in the collect operating position, respectively.
Figure 7:
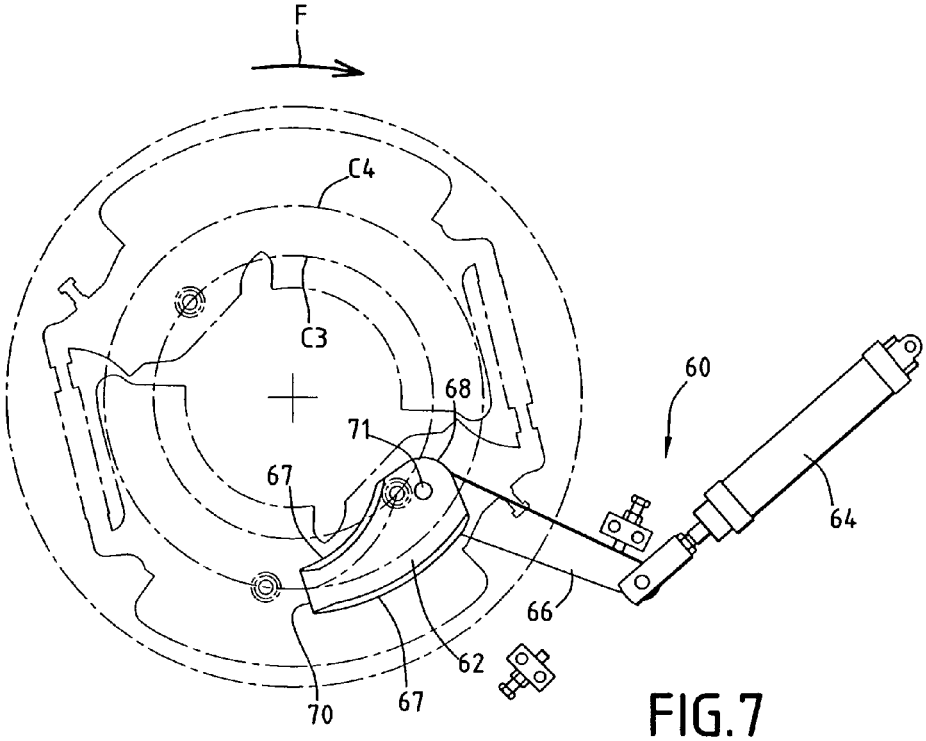

FIGS. 6 and 7 illustrate the system for controlling the configuration change of the covering cam 36. The rotation direction of the covering cam 36 is illustrated therein with the arrow F. This system 60 includes a switching member 62 which can be actuated by a jack 64 and optionally an arm 66. The jack 64 is a dual-effect pneumatic jack.

The switching member 62 is, for example, constituted by a rail which is delimited by two lateral edges 67 and which converges from a wide inlet 68 towards a narrow outlet 70.

The switching member 62 may pivot at a point 71 relative to the wall 24 between a first position (FIG. 6) in which the outlet 70 is close to the axis A, and a second position (FIG. 7) in which the outlet 70 is remote from the axis A.

The switching member 62 is intended to co-operate, as will be described below, with elements, for example, rollers 72, carried by the intermediate articulations 56 of the toggle joint mechanisms 44.

In straight mode, the covering cam 36 is in the configuration illustrated in FIG. 5 and the switching member 62 is in the position illustrated in FIG. 6.

The outer surfaces 50 of the semi-cams 40 are therefore radially recessed and do not interfere with the reliefs of the control cams 26 and 28. That is to say, the followers 34 of the covering cam 36 do not come into contact with the covering cam 36 and the movements of the series of pins 6 to 8 and the tucking blades 9 to 11 are controlled only by the cam followers associated with the cams 26 and 28 which travel thereon.

During the rotation of the covering cam 36 about the axis A, the two rollers 72 carried by the intermediate articulations 56 of the mechanisms 44 move into the switching member 62 without coming into contact with the lateral edges 67 thereof. The trajectory of the rollers 72 is illustrated by the circle C3.

When it is desirable to move into collect mode, the jack 64 brings about the movement of the switching member 62 into the remote position of FIG. 7. The first roller 72 to be introduced into the switching member 62 owing to the rotation of the cam 36 progressively comes into contact with the inner edge 67 which brings about the progressive radial extraction of the roller 72 as far as the trajectory illustrated by the circle C4. The corresponding toggle joint mechanism 44 moves, under the combined action of the springs 42 which urge the semi-cams 40 to their positions of FIG. 4, into an aligned position, then into the non-aligned position of FIG. 4. The covering cam 36 is in the configuration of FIG. 4. The radially outer edges 50 of the semi-cams 40 are situated radially further outwards than the bases of the hollow portions of the control cam 26 and the hollow portions 37 of the control cam 28.

In this manner, the cam followers 34 which travel on the outer surfaces 50 will prevent the followers of the control cams 26 and 28 from being introduced into these hollow portions.

The covering cam 36 therefore interferes with the control cams 26 and 28 in order to be able to reach the collect mode described with reference to FIG. 2.

The movement from collect mode to straight mode is carried out by means of radial movement of portions of the covering cam 36. All the problems linked to the disengagement/reengagement and to the angular positioning of the prior art are therefore eliminated.

In this manner, the movement from one operating mode to the other is reliable, rapid and may be entirely automated as described above.

Generally, the cam 36 therefore has a simple and reliable operation and is economical.

It can further be seen that it is not necessary to provide a device for immobilisation of the covering cam 36 in straight mode, which further simplifies the structure and eliminates the problems associated with these immobilisation devices.

Furthermore, in straight mode, the rollers 34 do not come into contact with the covering cam 36, which therefore limits the wear of these various elements.

Furthermore, the covering cam 36 forms an assembly which is mechanically bistable; it is not liable to be affected by a loss of electrical power or a total loss of pressure in the supply circuit.

It should further be noted that the use of two semi-cams 36 which are each intended to act with the cam followers 30 allows the rotation speed thereof to be reduced by twice the amount compared with a cam which has a single sector which is twice as long.

The kinetic energy which is linked to the rotation of the cam 36 is therefore divided by four, which may be particularly advantageous for folders having a high production speed.

In the example described above, the same covering cam is used at the same time to interfere with the control cams 26 and 28, which allows a cam to be saved compared with folders which previously used two.

However, in specific operating modes, it may be possible to envisage using two covering cams, each being associated with a control cam.

In the same manner, the covering cam 36 may have a different structure, for example, with a single active portion, and whose radial movement is not necessarily brought about by a toggle joint mechanism.

The jack 64 is preferably provided with blocking members for the exhaust chambers thereof in order to overcome any untimely cutting of air during production.

The jack 64 may be more generally replaced by any other activation device and may be provided with sensors for detection of the position thereof.

Figure 8:
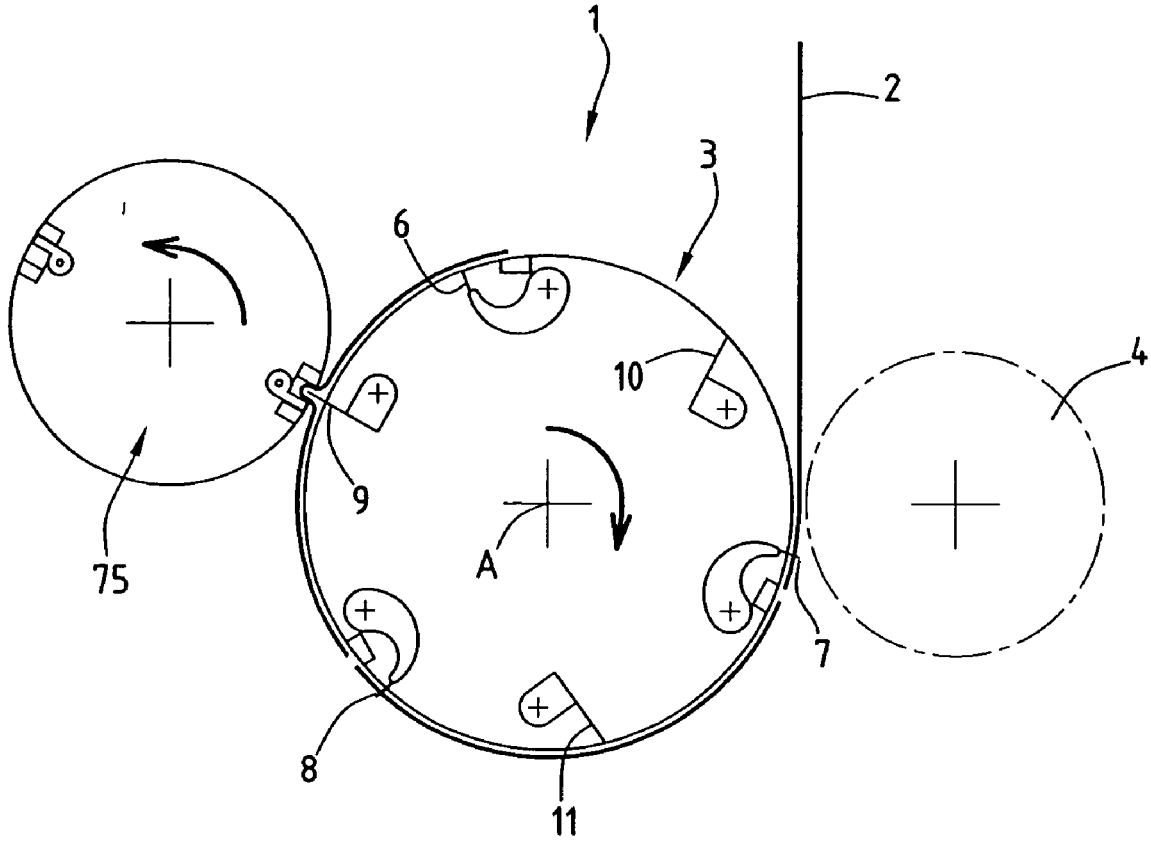
FIG. 8 is a schematic view illustrating a jaw folder.

As indicated above, the invention may also be used for a jaw folder. As illustrated in FIG. 8, in a folder of this type, the rollers 5 are replaced with a jaw cylinder 75.

The invention claimed is:

1. A folder for cutting and folding a web of paper comprising:

a cutting device for cutting sheets from the web;

a folding cylinder including movable retention devices and movable tucking blades for folding the sheets cut from the web, the cylinder being rotatably moved about an axis thereof;

a first control cam for controlling the movement of the movable retention devices by contact with first cam followers;

a second control cam for controlling the movement of the tucking blades by contact with second cam followers;

at least one covering cam having a configuration for collect operation, the covering cam inhibiting at least one of the first and second control cams, and a configuration for straight operation where the covering cam does not inhibit the first and second control cams; and a switch for controlling the covering cam and a device for moving the switch between a radially remote position in which the switch guides an element carried by the covering cam radially outwards so the covering cam moves into the configuration for collect operation, and a close position in which the switch guides the element radially inwards so the covering cam moves into the configuration for straight operation;

the covering cam including two semi-cams being substantially mutually symmetrical relative to the axis of the folding cylinder and radially movable between a retracted position and an extended position, the covering cam being in the configuration for straight operation when the semi-cams are in the retracted position and in a configuration for collect operation when the semi-cams are in the extended position.

2. The folder as recited in 1 wherein the covering cam neutralizes zones of the first control cam and zones of the second control cam.

3. The folder as recited in 1 wherein the configurations for collect operation and straight operation are mechanically stable.

4. The folder as recited in claim 3 wherein the covering cam includes at least one toggle joint mechanism moving via an aligned position when moving from the configuration for collect operation to the configuration for straight operation.

5. The folder as recited in claim 4 wherein the covering cam includes a hub on which the two semi-cams are articulated, each semi-cam being further connected to the hub via the toggle joint mechanism.

6. The folder as recited in claim 1 wherein the covering cam includes at least one return device for returning each semi-cam to the extended position.

7. The folder as recited in claim 6 wherein the return device is a gas spring.

8. The folder as recited in claim 1 further comprising two rollers co-operating with the tucking blades of the folding cylinder.

9. The folder as recited in claim 1 further comprising a jaw cylinder co-operating with the tucking blades of the folding cylinder.

* * * * *